United States Patent [19]

Hiltner

[11] Patent Number: 4,487,143

[45] Date of Patent: Dec. 11, 1984

[54] SELF-OILING BAG-CLOSING SEWING MACHINE WITH IMPROVED LUBRICATION SYSTEM FOR DRIVE SHAFT AND FEED DOG ASSEMBLY

[75] Inventor: Andrew J. Hiltner, Minneapolis, Minn.

[73] Assignee: Axia Incorporated, Minneapolis, Minn.

[21] Appl. No.: 498,265

[22] Filed: May 25, 1983

[51] Int. Cl.[3] ..... D05B 71/00

[52] U.S. Cl. ..... 112/256; 112/11; 112/169; 112/323

[58] Field of Search ..... 112/256, 11, 10, 169, 112/323; 184/6.15

[56] References Cited

U.S. PATENT DOCUMENTS

| | | | |
|---|---|---|---|
| 3,478,709 | 11/1969 | Fischbein et al. | 112/256 |
| 3,769,925 | 11/1973 | Von Hagen | 112/256 |
| 3,785,310 | 1/1974 | Marforio | 112/256 |
| 4,284,019 | 8/1981 | Marchesi | 112/256 |
| 4,348,970 | 9/1982 | Robinson et al. | 112/256 |
| 4,441,442 | 4/1984 | Robinson et al. | 112/256 |

*Primary Examiner*—H. Hampton Hunter

*Attorney, Agent, or Firm*—Williamson, Bains, Moore & Hansen

[57] ABSTRACT

An improved self-oiling system for the drive shaft and feed dog assembly of a portable, bag-closing sewing machine utilizes a drive shaft having an internal axial oil channel, an upper radial oil bore which extends from the oil channel to the outer periphery of the shaft to confront the lower main drive shaft bearing, and a lower radial oil passage which extends between the oil channel and the outer periphery of a feed dog eccentric cam which is integral with the lower end of the drive shaft. Oil is supplied to the lower main drive shaft bearing for further downward distribution along the bore, channel and passage to the outer periphery of the feed dog cam which is rotatably received in the feed dog block. An oil passage within the feed dog block delivers oil from the feed dog cam radial oil passage to a slide bearing within the block to lubricate the interface between a guide post and the slide bearing. Annular recesses are provided on the shaft and post to further enhance transfer of oil within the machine. The described oil distribution network utilizes the centrifugal force of the rotating drive shaft and the oscillation of the moving feed dog block to transfer and distribute oil.

15 Claims, 6 Drawing Figures

SELF-OILING BAG-CLOSING SEWING MACHINE WITH IMPROVED LUBRICATION SYSTEM FOR DRIVE SHAFT AND FEED DOG ASSEMBLY

BACKGROUND OF THE INVENTION

This invention relates to the field of portable bag-shaft closing sewing machines and comprises an improved drive shaft and feed dog assembly oiling system.

Portable bag-closing sewing machines are used in packaging situations where the quantity of filled bags produced and requiring closure is not continuous and where heavy, stationary machines are not practical or available. Often the bags which require closure are filled with granular, fibrous or abrasive materials, and the portable machine is required to function efficiently over long periods under extremely dusty conditions and often abusive handling situations. In some applications, the portable machines see almost round-the-clock duty in assembly line or shipping dock environments, and it is virtually impossible to shelter all moving parts of the machine from the dusty, abrasive materials present in the working area. To insure continued, uninterrupted operation under these conditions, regular and complete lubrication of the machine is critical.

A self-oiling portable bag-closing sewing machine has been developed and is shown in U.S. Pat. No. 4,348,970, issued Sept. 14, 1982 and titled "Self-Oiling Portable Bag-Closing Sewing Machine". A further improvement of the oiling system of that patent is disclosed in U.S. Pat. No. 4,441,442, dated Apr. 10, 1984, and titled "Self-Oiling Portable Bag-Closing Sewing Machine With Pump".

As will be appreciated by those familiar with portable bag-closing sewing machines, the feed dog assembly, which cooperates with the needle to move fabric past the needle, is generally located at the lowermost portion of the sewing machine and is accordingly remote from the usual oil sources and difficult to lubricate. In the portable bag-closing lubrication devices and systems described in the above patent, the oil feservoir is located near the top of the machine, and while oil may be injected to one or more of the main drive shaft bearings, it otherwise originates at the upper portion of the machine and must work its way to the most distant reaches of the machine such as the feed dog assembly. Due to the need to keep the weight and size of the machine within workable limits for one hand operation, it is virtually impossible to carry large oil reservoirs or extensive internal oil supply conduits, extensive sumps, seals and the like with a portable machine.

While large, heavy, stationary pedestal-type bag closing machines of the type shown in U.S. Pat. No. No. 3,478,709 can carry such pumps, sump reservoirs and the elaborate internal and space consuming conduits, seals and the like, a commercially acceptable portable machine must remain compact, lightweight and easy to handle with a single hand for long periods of operation. Because of these weight and size limitations, oil delivery to the feed dog assembly of portable machines has been accomplished largely by gravity flow as the oil works its way downward from the upper regions of the machine. While some success has been achieved using the gravity flow delivery system, it has been found that much of the oil delivered to the machine is consumed or diverted before reaching the feed dog assembly. Accordingly, there remains a need to reliably, consistently deliver a greater quantity of oil to the remotely positioned feed dog assembly at the lower end of the machine, without requiring significant additional operator labor and without the introduction of additional space consuming components or extra weight. The present invention accomplishes these goals.

SUMMARY OF THE INVENTION

The invention relates to the field of self-oiling portable bag-closing sewing machines of the type which are hand held by an operator and used for the closing of sacks and bags.

The invention is directed to solving the problem of lubrication of the feed dog assembly and lower drive shaft area which is located remotely from other components of the bag-closing sewing machine and is extremely challenging and difficult to lubricate with a self-oiling system. The long-standing problem of delivering oil from the main drive train chamber of the machine to the distant and isolated feed dog chamber is solved by channeling the oil within the main drive shaft and then having such oil pass axially along and within the drive shaft from the drive train chamber to the feed dog chamber.

The invention utilizes a drive shaft which is modified by having an elongated oil channel bored from the lower end of the shaft upwardly along the shaft axis. This channel intersects an oil bore which extends radially from the channel and terminates at the outer periphery of the drive shaft within the lower main drive shaft bearing. Accordingly, oil supplied from the main oil reservoir to the lower main drive shaft bearing is delivered to the oil channel within the drive shaft for downward flow within the shaft.

The drive shaft has an integral feed dog eccentric cam at its lower end, and an oil passage is drilled radially from the outer periphery of the cam to intersect the oil channel of the shaft. A closure means is inserted in the lower end of the oil channel to prevent escape of the oil from the bottom of the drive shaft. Oil from the central oil channel is thus directed to the outer periphery of the feed dog cam and lubricates the interior of the main feed dog bearing which rotatably journals the feed dog cam. In the preferred embodiment, an annular recess is provided around both the drive shaft and the feed dog cam within the drive shaft bearing and main feed dog bearing, respectively, to provide a local, small oil reservoir to aid the movement of oil through the machine and to thoroughly surround each bearing with oil to assure complete lubrication of the bearing interface.

A feed dog block oil passage communicates with the annular recess of the feed dog cam and extends between the main feed dog bearing and a slide bearing positioned generally horizontally in the feed dog block. A post which is slidably mounted in the slide bearing has an annular recess which communicates with the feed dog oil passage and assures complete lubrication of the post.

The rotating shaft generates centrifugal forces on the oil contained in the oil passage within the feed dog cam to urge such oil radially outwardly into the feed dog bearing to assist in oil distribution. The oscillatory movement of the feed dog block aids substantially in distributing the oil to the slide bearing and distributes the oil evenly to moving parts within the feed dog block.

The improved oiling system does not add additional weight or bulk to the machine, consumes no additional space, introduces no additional material or other parts while reliably, consistently delivering oil directly to the feed dog assembly, with the maximal effort required from the operator consisting only if the occasional depression of a pump plunger located on the handle.

These and other objects and advantages of the invention will appear more fully from the following description with the accompanying drawings wherein like reference characters refer to the same or similar parts throughout the several views.

DESCRIPTION OF THE PREFERRED EMBODIMENT

Figure 1:
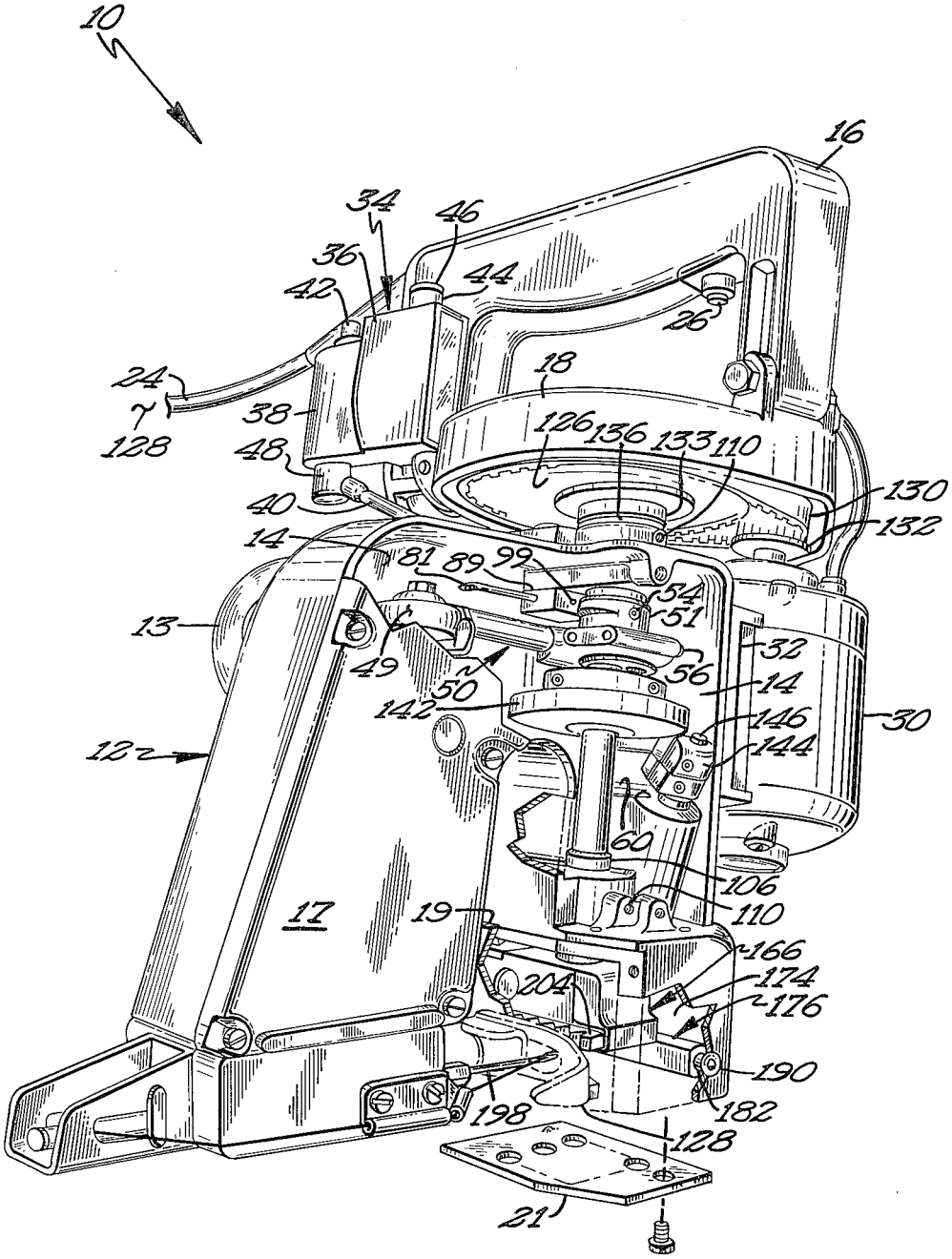
FIG. 1 is a front perspective, partially exploded view of a portable, bag-closing sewing machine embodying the invention and wherein portions are partially cut away and shown in phantom to better disclose the invention.

Referring now to FIG. 1, a self-oiling portable bag-closing sewing machine 10 of the type disclosed in U.S. Pat. No. 4,348,970, issued Sept. 14, 1982, which patent is hereby incorporated herein by reference, utilizes a rigid protective housing 12 having a hollow, generally U-shaped internal drive train chamber 14 and a feed dog chamber 174. The housing 12 carries a thread spool 13 and includes appropriate cover plates 17, 19 and 21 secured by screws to the housing. The housing 12 further includes a handle 16 at the top of the machine 10 and a rigid guard 18 affixed to the handle by any known means so as to protect an operator from entanglement in pulley belt 130.

An electrical power cord 24 enters handle 16 and is operatively electrically connected with push button switch 26 which, when depressed by an operator, allows electrical current flow from a power source 128 to motor 30 which is securely mounted to the housing 12 by bracket 32.

The handle 16 supports and carries a combined oil reservoir and pump housing 34 which collectively comprises an oil source for the machine 10 and is retained to the handle by screw 20. Oil is added as needed to the reservoir 36 through filler tube 44 which is closed by cap 46.

The housing 34 is molded as an integral unit with an oil reservoir section 36 and a pump section 38, such sections being constructed to permit internal oil flow from the reservoir to the pump with oil leaving the integral housing 34 through oil line hose coupling 48 in response to manual operation of pump plunger 42 or by downward, gravity oil flow. If gravity flow is utilized, it is desirable to utilize an oil flow control valve as shown in U.S. Pat. No. 4,348,970.

While it is preferred to utilize the combined reservoir and pump as shown at 34, the invention described herein will function satisfactorily with a gravity flow oil reservoir providing the oil source, as disclosed in U.S. Pat. No. 4,348,970.

Figure 2:
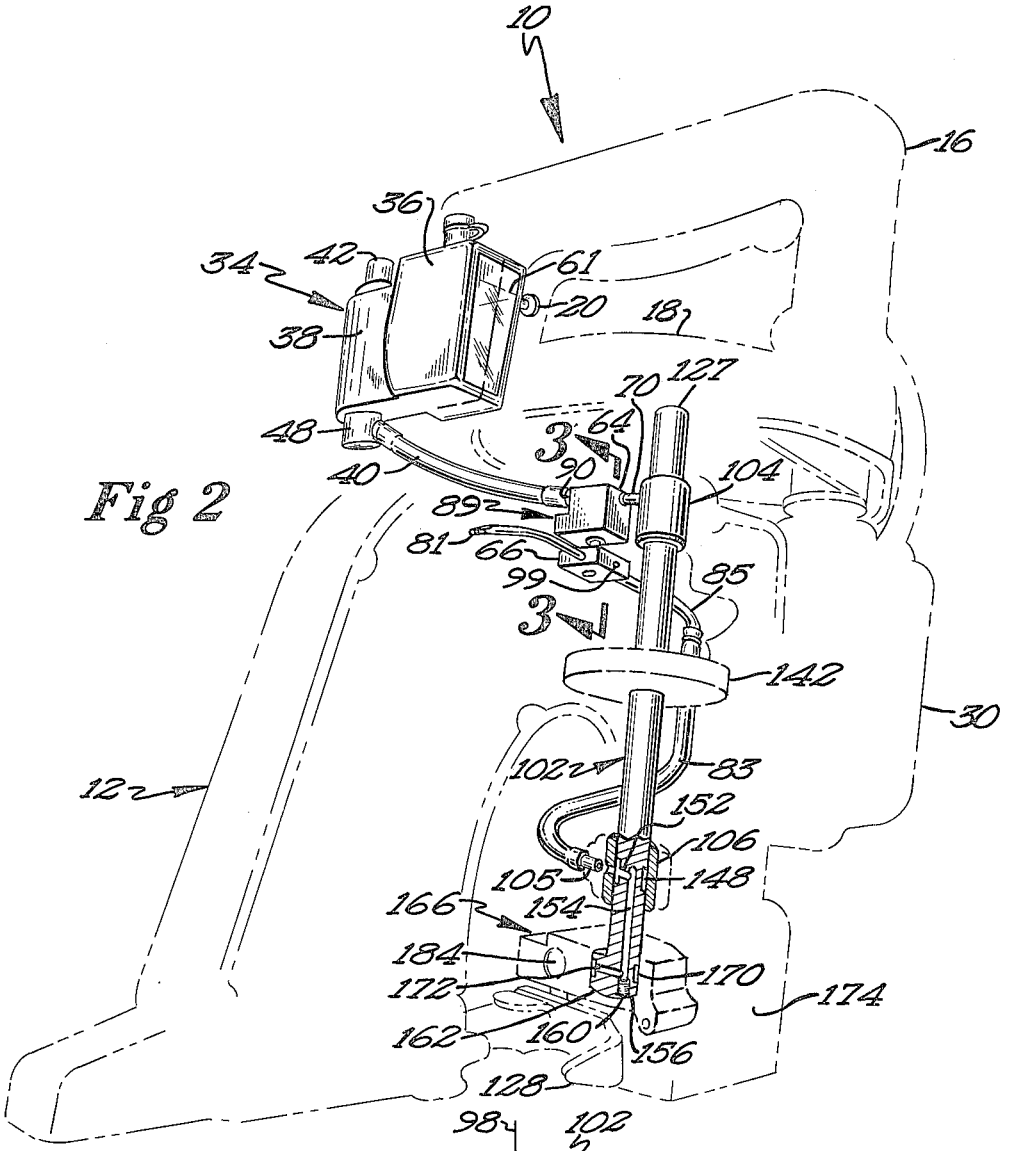
FIG. 2 is a perspective view taken partly in cross section of the self-oiling system utilized with the invention and in which the portions of the portable, bag-closing sewing machine are shown in phantom.
Figure 3:
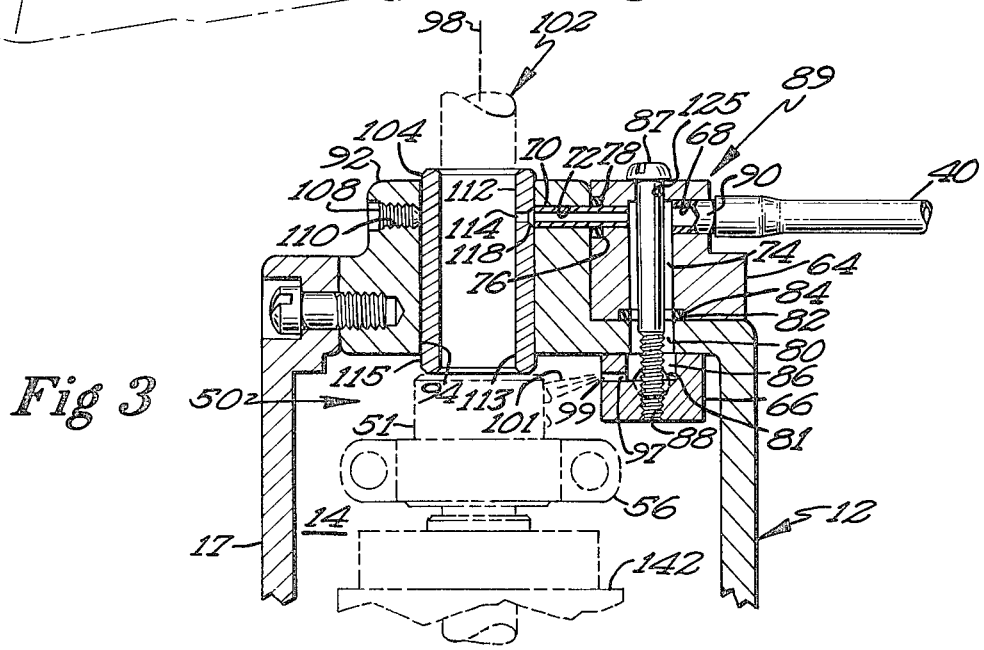
FIG. 3 is a cross-sectional, side view of the upper main drive shaft bearing and oil manifold taken in the direction of cutting plane 3—3 of FIG. 2 with the drive shaft and certain of its attached components shown in phantom.

The hose coupling 48 of the oil source 34 is connected with downwardly extending, flexible connecting hose 40 which extends to oil manifold 89 as best shown in FIGS. 1, 2 and 3.

The oil manifold 89 includes upper manifold 64 and lower manifold 66 with the upper manifold being positioned outside and on top of the housing 12 and the lower manifold 66 being positioned beneath and opposite upper manifold 64 within the drive train chamber 14. The upper manifold 64 may be formed of any suitable material capable of withstanding and containing oil therein and is provided with a manifold inlet port 68 into which hose coupling 90 is sealably received.

A first manifold outlet port is provided by brass fitting 70 which is force fitting into manifold 64 and communicates with a generally vertical plenum 74 into which oil is delivered from inlet port 68. The brass fitting 70 extends laterally into oil bore 72 of boss 92. An annular slot 76 encircles oil bore 72 and receives sealing "O" ring 78, which when compressed between manifold 64 and boss 92 forms a secure oil seal therebetween.

An oil delivery hole 80 extends through the top of the housing 12 adjacent boss 92 and communicates directly, axially with cylindrical plenum 74 as best shown in FIG. 3. An annular slot 82 is formed in the bottom of the upper manifold 64 concentric with the plenum 74 and receives an annular "O" ring 84, which when compressed between the housing 12 and the upper manifold 64 provides a tight oil-resistant seal. The lower manifold 66 includes a central, generally upright cylindrical plenum 86 which communicates with the oil delivery hole 80 and upper plenum 74. A threaded bore 88 positioned co-axially with the upper and lower plenums 74 and 86 retains the lower end of machine screw 87 which passes through hole 125 in the top of the upper manifold and through the oil hole 80 before being threaded into bore 88. The plenums 74 and 86 are of larger diameter than screw 87 to provide ample clearance to allow downward flow of oil from the upper manifold 64 to the lower manifold 66. When screw 87 is tightened into threaded bore 88, the "O" rings 84 and 78 are compressed against the housing 12 and boss 92, respectively, to provide adequate oil-tight seals.

Referring to FIG. 2, the plenum 86 communicates directly with a second manifold outlet port 85 which connects to oil delivery hose 83 which extends to the lower main drive shaft bearing 106 which will be described further hereafter. A third manifold outlet port 81 extends laterally from plenum 86 toward and overlies the universal joint 49 of needle driving assembly 50 to apply oil directly thereto.

A fourth manifold outlet port 97 extends laterally from the plenum 86 and terminates in a small orifice 99, by which a jet of oil 101 may be ejected directly onto the needle driving cam 51 which actuates the needle driving assembly in order to provide direct lubrication thereto.

Accordingly, the hose 40, oil manifold 89, port 85, hose 83 and hose coupling 105 collectively comprise one type of oil delivery means suitable for transmitting oil from the oil source 34 to the main drive shaft bearings 104 and 106 and to the needle driving assembly 50. Although the specifically identified components are shown as being workable with the invention, it should be understood that other oil transfer hardware which accomplishes the same purpose may be substituted and is within the scope of the invention.

Figure 6:
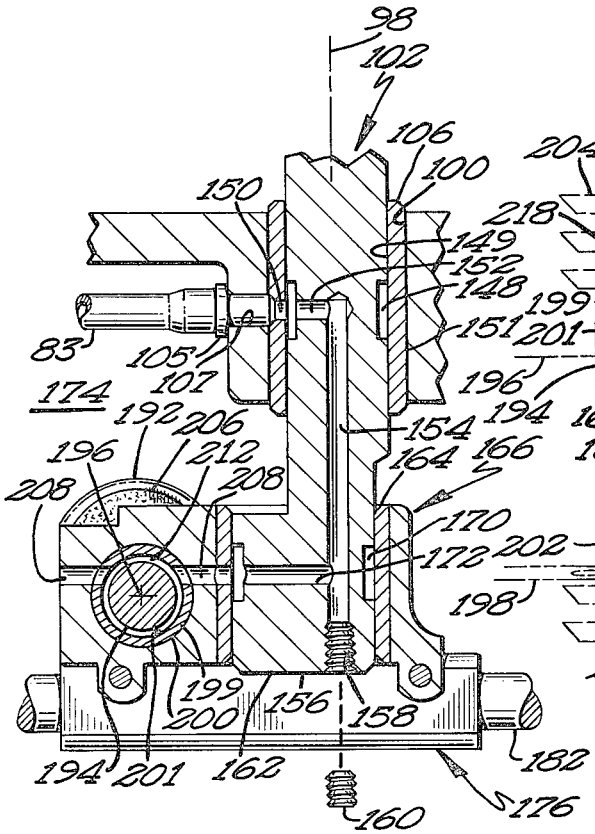
FIG. 6 is a cross-sectional, side elevation view of a portion of the feed dog block taken in the direction of cutting plane 6—6 of FIG. 5.

The hose 83 extends downwardly from port 85 and within the drive train chamber 14 until it reaches a ledge 60 as best shown in FIGS. 1 and 6. An aperture is bored in ledge 60 to permit the hose 83 to pass therethrough and to thereafter be connected with nipple 105 which is retained within bore 107 which extends to bearing aperture 100 of lower main drive shaft bearing 106. Accordingly, the hose 83 delivers oil directly to the lower main drive shaft bearing for lubrication of the bearing and additionally stores oil for downward seepage into the bearing.

Referring again to FIG. 3, the boss 92 is cast as an integral part of the housing 12 and has a bearing aperture 94 bored axially therealong. The aperture 94 has a central longitudinal axis 98, and a second bearing aperture 100 (FIGS. 4 and 5) is positioned co-axially with the aperture 94 so that apertures 94 and 100 can receive co-axially aligned first and second main drive shaft bearings 104 and 106, respectively, which rotatably journal generally upright main drive shaft 102.

The upper and lower main drive shaft bearings 104 and 106, respectively, are retained within apertures 94 and 100, respectively, by one or more set screws 108 received within threaded apertures 110 as best shown in FIGS. 1 and 3. Accordingly, the bearings 104 and 106 are positioned to have a common central longitudinal axis 98 and rotatably receive main drive shaft 102 therein and rotatably retain the drive shaft in the shown upright orientation of FIGS. 1 and 2.

Referring now to FIGS. 2 and 3, upper main drive shaft bearing 104 is cylindrical in configuration with a central aperture 112 in which main drive shaft 102 is received. The bearing 104 has an oil port 114 extending radially outwardly therethrough from inner periphery 113 to outer periphery 115, and the bearing 104 is oriented so that oil port 114 communicates with oil bore 72 and brass fitting 70 of the oil manifold 89. Preferably the oil port 114 has an outer countersink 118 to simplify alignment between port 114 and fitting 70.

Referring next to FIG. 1, a pulley wheel 126 is rigidly attached to the main drive shaft at the upper end 127 thereof by any known means so that pulley wheel 126 rotates with drive shaft 102. A timing belt 130 extends about the outer rim of pulley wheel 126 and to and around pulley 132 which is affixed to the shaft of motor 30. The motor 30, pulleys 132 and 126, timing belt 130 and main drive shaft 102 collectively comprise a driving means for the machine 10 by which the main drive shaft is rotated when motor 30 is energized.

A split collar 133 (FIG. 1) is adjustably secured to drive shaft 102 by a tightening screw and provides a convenient device for adjusting the degree of permitted end play of shaft 102. A thrust washer 136 is positioned immediately beneath split collar 133 and contacts the upper end of bearing 104.

Referring again to FIG. 1, a needle drive eccentric cam 51 is rigidly attached to the drive shaft adjacent the bearing 104 by a set screw 54. The eccentric 51 is rotatably received in an end of needle drive connecting rod 56 and comprises a part of the needle driving assembly 50 which reciprocates needle 198 during the stitching operation. Because the needle driving assembly is well known to the art, is not directly involved with the improved lubrication system disclosed herein and is fully disclosed in U.S. Pat. No. 4,348,970, it will not be further described herein.

As best shown in FIGS. 1 and 2, a presser foot assembly 128 bears against the feed dog 204 of the machine 10 and is spring loaded to engage a bag's fabric (not shown) and hold it against the feed dog. Because the construction and operation of the presser foot assembly is well known to the art and described in U.S. Pat. No. 4,348,970, it will not be further described.

Referring again to FIG. 1, a substantially circular looper cam 142 is rigidly retained to the shaft 102 so that cam 142 rotates with shaft 102 and at the same angular velocity. The rotating cam 142 controls movement of a cam follower arm 144 which is fixed to looper shaft 146 in order to actuate a swinging looper hook during stitching of bags. Because the looper mechanism is not directly related to the present invention and is disclosed in U.S. Pat. No. 4,348,970, it will not be discussed further herein.

Referring now to FIG. 6, the drive shaft 102 is provided with a drive shaft bearing annular recess 148 which confronts the inner periphery 149 of the lower drive shaft bearing 106. The recess 148 encircles shaft 102 and confronts and communicates with oil entry port 150 which extends between the inner and outer peripheries 149 and 151 of bearing 106. The port 150 is in direct communication with the bore 107 so as to permit oil flow from the hose 83 through bore 107, oil port 150 and into the annular recess 148.

The drive shaft 102 has a generally radial oil bore 152 drilled from the outer circumference of the shaft 102 inwardly along a radius of the shaft to a point slightly past the central axis 98, the oil bore 152 being in direct communication with the annular recess 148. An oil channel 154 is bored into drive shaft 102 from the lower end 156 thereof and substantially centered on the longitudinal central axis 98 of the shaft. The oil channel 154 extends from the lower end 156 of the shaft upwardly to communicate with the radial oil bore 152, thereby permitting oil flow from bore 152 downwardly along the channel 154. The lower end of the channel 154 is provided with a thread 158 to receive a set screw 160 which provides a means for closing the lower end of the oil channel to permit oil to accumulate within the oil channel 154 for subsequent distribution to the feed dog block as will be described hereafter.

As best shown in FIGS. 2 and 4–6, the drive shaft 102 is provided with an integral eccentric feed dog cam 162 which is rotatably journaled in the feed dog bearing 164 of feed dog block 166. The outer periphery 168 of the cam 162 has a feed dog cam annular recess 170 which encircles cam 162 and joins the feed dog cam oil passage 172, which extends within cam 162 from the outer periphery 168 to the central oil channel 154 to permit oil flow from channel 154 to reach the annular recess 170.

The described oil bore 152, oil channel 154, oil passage 172 and annular recesses 148 and 170 collectively define an oil guideway which extends from the oil entry port 150 to the feed dog cam 162 and which receives oil from the port 150 and guides it to the outer periphery of the feed dog cam to assure lubrication of the cam and of the feed dog bearing 164. While the oil guideway has been shown herein as comprising three specifically positioned bores wholly within the drive shaft, it should be understood that other bore arrangements or positions associated with the drive shaft including open troughs on the feed dog cam 162, which direct the oil to the outer periphery of the cam 162, are contemplated and are within the purview of the invention.

Figure 4:
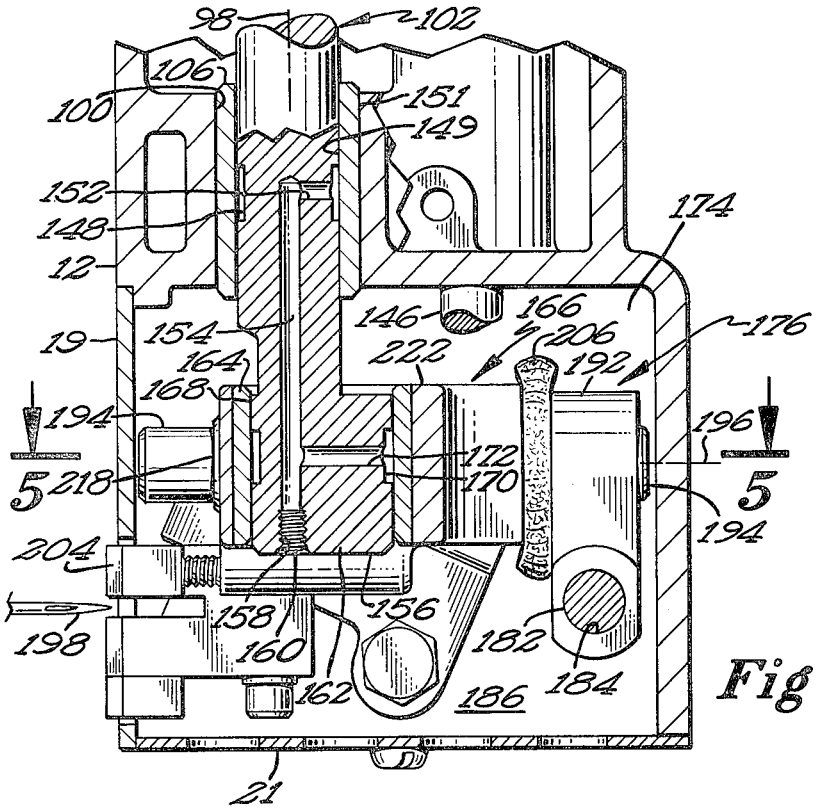
FIG. 4 is a cross-sectional, side elevation view of the lower drive train chamber and feed dog chamber of the machine of FIG. 1.
Figure 5:
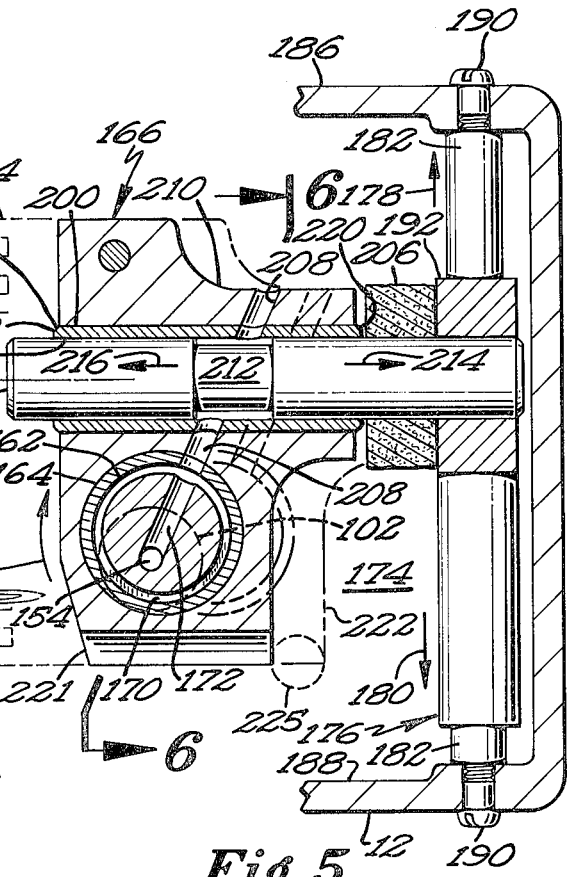
FIG. 5 is a top cross-sectional view, partly in phantom, of the feed dog assembly taken in the direction of cutting plane 5—5 of FIG. 5 and showing alternative positions of the movable feed dog block.

Referring now to FIGS. 4–6, within the feed dog chamber 174 a slide 176 is mounted for sliding reciprocating movement in directions 178 and 180 along stationary elongated rod 182 which passes through slide aperture 184 (FIG. 4) of slide 176 and is rigidly fixed to the side walls 186 and 188 of feed dog chamber 174 by screws 190 threaded into the terminal ends of the rod 182. Extending laterally, transversely from upwardly extending ear 192 of the slide 176 is a cantilevered, circular cross section fixed post 194 which is force fitted into slide 176 and forms a part of the slide. A transverse aperture 200 in feed dog block 166 has slide bearing 199 therein. The bearing has a central axis 196 and receives post 194 in bearing aperture 201 for sliding axial movement of the block 166 along the post 194.

Accordingly, the slide 176 mounted on stationary rod 182 and having cantilevered post 194 slidably carrying bearing 199 of the feed dog block, supports and guides the feed dog block 166 as the block moves in response to rotation of eccentric cam 162 of the shaft 102. This slide 176 and rod 182 serve as a guide means for the feed dog block. As drive shaft 102 rotates in direction 202 (FIG. 5), the feed dog block 166 describes an elliptical, and more specifically, a circular path as it slides axially along post 194 and as slide 176 moves with the feed dog block along rod 182. For example, it should be noted that the corner 191 of feed dog block 166 moves in a path 225 during operation.

Rigidly fixed to the feed dog block 166 for movement with the block is a toothed feed dog 204 which confronts and intermittently bears against presser foot 128 during operation. Because the feed dog block moves in response to rotation of the drive shaft 102, the block will be moving in a generally circular path at a speed typically ranging between 1,000 and 1,500 revolutions per minute.

Slide 176, stationary rod 182, post 194 and the feed dog block 166 with feed dog 204 collectively comprise a feed dog assembly usable with the portable bag-closing machine 10.

Referring now to FIGS. 5 and 6, a feed dog block oil passage 208 is bored from the reverse side 210 of the feed dog block 166 transversely, horizontally across the block, intersecting the bearing 199 and the bearing 164 to directly confront and communicate with the feed dog cam annular recess 170 of the cam 162. The passage 208 is generally perpendicular to the drive shaft axis 98 and is substantially horizontal when the drive shaft 102 is vertically disposed during normal operation. The passage 208 is positioned in vertical alignment with bore 172 to intersect the bearing 164 at a location where it is in substantial axial, radial alignment with bore 172.

As best shown in FIG. 6, the feed dog block oil passage 208 is positioned to intersect the bearing 199 at a location above the central longitudinal axis 196 of the post 194 to permit oil to be delivered to the upper half of the bearing 199 to assure more even distribution about the entire circular periphery of the bearing. The post 194 may be provided with an annular recess 212 (FIG. 5) which communicates with and confronts the oil passage 208 so as to receive oil in the recess 212 and to move it laterally along the bearing 199 as the post 194 slides in directions 214 and 216.

A porous oil storage medium such as a washer or gasket 206 formed of compressible, oil absorbing material, such as felt, leather or the like, is positioned on the post 194 between ear 192 and feed dog block 166 so that excess oil leaving slide bearing 199 along the post 194 is absorbed and stored by the washer 206 for subsequent release. The washer 206 is constructed such that it receives slight compression each time the feed dog block moves toward the ear 192 so that a quantity of oil is released from the gasket onto the shaft 194 each time the washer 206 is compressed.

The looper shaft 146 extends downwardly into the feed dog chamber 174 and actuates a looper hook, not shown, but because the structure of the looper assembly is well known to those having ordinary skill in the art and is disclosed in U.S. Pat. No. 4,348,970, it will not be described further herein. It should also be understood that various peripheral sub-assemblies such as a thread cutting apparatus and a thread feeding system are associated with the machine, but since they are well known to the art, and are disclosed in the above patent, they need not be described further herein.

OPERATION OF THE INVENTION

In operation, the reservoir 36 is first filled with oil to a level 61 adequate to provide a supply of oil for a reasonable time interval, such oil being added through filler tube 44 and the cap 46 then closing the tube. Before actuating the motor 30, the operator depresses pump plunger 42 to eject a quantity of oil from the pump housing 38 to and along the oil hose 40. While the invention has been described as utilizing a manually actuated pump 38, it should be understood that in some circumstances, the oil reservoir 36, without a pump, can be used to distribute oil downwardly to the line 40 by gravity flow and that the pump, while helpful, is not essential. In such circumstances where a pump is not used, it may be desirable to provide a flow control valve in reservoir 36 to regulate the oil flow to line 40, as is disclosed in U.S. Pat. No. 4,348,970.

Oil flows along hose 40 by pump pressure or gravity flow, and enters the oil manifold 89 through hose coupling 90 to subsequently fill the upper and lower plenums 74 and 86, respectively, and to flow along fitting 70 to an oil port 114 in upper main drive shaft bearing 104. Oil entering the bearing 104 works its way around the inner periphery of the bearing to provide needed lubrication between the bearing 104 and the drive shaft 102.

Oil within the lower plenum 86 of oil manifold 89 leaves the lower plenum by three paths. Some oil moves outwardly along passage 97 and out orifice 99 as a pressurized jet 101 to land on the needle driving assembly. When the pump is absent, the oil reaches the cam 51 by gravity flow.

The remaining oil in lower plenum 86 flows downwardly through fitting 85 (FIG. 2) and into hose 83 which conveys such oil to hose fitting 105 which extends to lower main drive shaft bearing 106 as best shown in FIGS. 2 and 6. It should also be understood that stored oil remains in the hose 83 and seeps slowly downwardly as will be described hereafter as it is used for lubrication purposes.

Oil leaves hose 83 and enters lower main drive shaft bearing 106 by oil entry port 150 to be received in an annular recess 148 encircling drive shaft 102. As the recess 148 fills with oil, most of the overflow oil enters the radial oil bore 152 and flows downwardly into the connecting oil channel 154 where it forms a secondary oil reservoir and is dispensed downwardly to the feed dog block as needed.

Oil which accumulates in the drive shaft annular recess 148 and is below the level of the transverse radial oil bore 152 gradually seeps downwardly between the interface of shaft 102 and bearing 106 to lubricate the bearing and to be spread evenly throughout the bearing during rotation of the shaft 102. During rotation of the shaft 102, oil in the recess 148 is rotated and urged radially outwardly against the inner periphery 149 of the bearing and, in effect, flattened against the bearing to further encourage transfer of oil to all portions of the bearing's inner periphery. Capillary action is also helpful in moving the oil upwardly to the upper regions of the bearing when the shaft is stationary.

The lower threaded end 158 of the oil channel 154 is closed by the set screw 160, and accordingly, oil entering the channel 154 can leave the channel only through transverse oil passage 172 in the feed dog cam 162.

Oil leaving the oil passage 172 accumulates initially in feed dog cam annular recess 170 which encircles the feed dog cam 162 and provides a local reservoir in which oil may be stored in an annulus completely surrounding the periphery of the feed dog cam. When the shaft 102 is stationary, such oil is dispersed by downward gravity seepage between the interface of cam 162 and bearing 164 and by capillary action upwardly between the cam and bearing.

When the drive shaft 102 is rotating in response to motor operation, oil within horizontal passage 172 is urged radially outwardly along the axis of passage 172 toward the recess 170 by centrifugal force, thereby utilizing the normal rotational motion of the shaft 102 to provide a pump-like action to urge oil outwardly into the annular recess 170 and along the communicating oil passage 208 in the feed dog block. During such rotation of the shaft, oil stored in channel 154 flows readily downward with minimal centrifugal force being applied to such oil since the oil is substantially on the center line of the shaft 102 until the oil reaches passage 172. During rotation of the shaft, oil which is part of the annulus of oil within recess 170 is rotated with the shaft and is urged radially outwardly against the inner periphery of the main feed dog bearing 164, and the centrifugal force applied to such oil flattens it against the inner periphery of the bearing to further urge the oil to flow upwardly and downwardly to evenly lubricate all portions of the bearing's inner periphery.

Excess oil in the annular recess 170 flows outwardly into oil passage 208 which intersects the annular recess 212 in bearing 199, as best shown in FIG. 5. The oil entering recess 212 fills the recess to intermittently encircle the post 194 in an annulus of oil the width of the recess, such oil then seeping laterally along the post 194 in directions 214 and 216 to lubricate the interface between bearing and post. Some excess oil also leaves the block where passage 208 intersects side 210 to thereby assure steady oil flow and a continued freshening of the oil in the feed dog block. As the feed dog block 166 moves in directions 214 and 216 during operation of the sewing machine, the oil within recess 212 is carried in directions 214 and 216 by feed dog block movement and applied to the post 194. Inertial forces applied to the oil as it is carried within recess 212 toward direction 216 help force the oil along the thin interface between bearing 199 and post 194 as oil moves in direction 216 beyond the recess 212. Similarly inertia generated during the movement of oil in direction 214 by moving recess 212 urges the oil along the post in direction 214 beyond the end of the recess 212 to better lubricate the interface between the post and the bearing 199.

It should further be noted that the feed dog block 176 moves in a generally circular path 225 and consequently imparts inertial forces in a multitide of directions to the oil within passage 208 and in recess 212, causing the oil to shake and oscillate in various directions depending upon the specific instantaneous direction of movement of the feed dog block and thereby further enhances the lubrication process. Because the feed dog block moves in an oscillatory, back-and-forth movement, the oil within the passage 208 is oscillated back and forth along the passage, but is not urged radially outwardly as is the case with the rotating feed dog cam 162.

While the invention has been shown herein as including a plurality of annular recesses such as recesses 148, 170 and 212, it should be understood that although the recesses are helpful and desirable for encouraging oil flow and movement, such recesses can be deleted from the invention without impairing the operativeness of the invention.

Because the passage 208 (FIG. 6) is positioned above the central axis 196 of the port 194, oil flow along the passage tends to fill the annular recess 212 to approximately the level of passage 208 and retains such level, to thereby assure the existence of a fairly constant local oil reservoir for lubrication of the post 194, which prior to the invention was extremely difficult to lubricate effectively because of its substantial distance from the main oil reservoir 36.

Oil seeping along the interface between post 194 and bearing 199 eventually leaves the bearing at ends 218 and 220, the oil leaving end 218 seeping downwardly for eventual discharge from the sewing machine through perforated cover 21. Oil which seeps out of the remaining end 220 of feed dog block 176 encounters porous, absorptive gasket 206 and is absorbed by the gasket until the gasket reaches a point of saturation. Each time the feed dog block moves to position 222 (FIG. 4), the block squeezes the porous gasket 206 between the block and ear 192 causing some oil to be discharged onto post 194 where it re-enters the bearing 199 to further provide oil lubrication of the post 194. As the feed dog block 176 slides to its extreme alternative position 221 (FIG. 5), the end 220 is spaced from the gasket 206 and tends to pull the oil squeezed from the gasket 206 laterally along the post 194 in direction 216 to enhance post lubrication.

Accordingly, the disclosed embodiment of the invention results in a greatly improved lubrication system for both the main drive shaft and the feed dog assembly of a portable bag-closing sewing machine, delivering oil directly to the upper and lower main drive shaft bearings and to the main feed dog bearing and slide bearing 199 to eliminate a longstanding lubrication problem to these components of the sewing machine, which are positioned sufficiently distant from the main oil reservoir 36 as to make thorough lubrication challenging. It should also be understood that the present invention directed toward the improved lubrication of the main drive shaft and the feed dog assembly may be used in association with the lubrication systems shown in U.S. Pat. No. 4,348,970, and it is contemplated that the use of an oil mist within the drive train chamber and in the feed dog chamber, as taught in that patent, may be used in combination with the present invention.

While the preferred embodiments of the present invention have been described, it should be understood that various changes, adaptions and modifications may be made therein without departing from the spirit of the invention and the scope of the appended claims.

What is claimed is:

1. In combination with a self-oiling, portable, bag-closing sewing machine energizable from a power source and including a housing; an oil source carried by said housing and capable of storing oil; first and second main drive shaft bearings positioned along a common axis, and each said bearing having an inner and outer periphery with at least one of said bearings having a first oil entry port passing between said outer periphery and said inner periphery; and driving means selectively connectable to the power source, carried by said housing, and including a motor and a main drive shaft having a central longitudinal axis and upper and lower ends with said shaft being rotatably mounted in said first and second main drive shaft bearings for rotation about said longitudinal central axis and said main drive shaft being drivingly connected with said motor to rotate said main drive shaft when said motor is energized; and a feed dog assembly including a feed dog block having a main feed dog bearing therein; an improved lubrication system comprising:

oil delivery means connected in fluid flow relationship with said oil source and to said first oil entry port of said drive shaft bearing;

said main drive shaft further including a feed dog cam adjacent said lower end of said drive shaft, said cam having an outer periphery and being rotatably journaled in said main feed dog bearing to move said feed dog block along an eliptical path in response to rotation of said drive shaft;

said main drive shaft including an oil guideway extending from said first oil entry port to said feed dog cam, said guideway receiving oil from said first oil port and directing such oil to said outer periphery of said feed dog cam to lubricate said cam and said main feed dog bearing.

2. The combination of claim 1 wherein said oil guideway further includes an oil bore in said drive shaft communicating with said first oil entry port and further includes an oil channel within said main drive shaft and extending from said lower end of said shaft to said oil bore.

3. The combination of claim 2 wherein said oil guideway further includes a feed dog cam oil passage extending from said outer periphery of said cam to said oil channel of said drive shaft so that oil reaching said oil passage from said oil channel is urged outwardly along said oil passage by centrifugal force.

4. The combination according to claim 3 wherein said outer periphery of said feed dog cam has an annular recess encircling said cam and communicating with said feed dog cam oil passage to store oil therein for seepage between said cam and said feed dog main bearing.

5. The combination of claim 2 wherein said oil channel is positioned substantially along said longitudinal central axis of said drive shaft so as to minimize the effect of centrifugal force on oil flow within said channel during rotation of said shaft.

6. The combination of claim 2 and further including means closing the end of said oil channel at the said lower end of said drive shaft to encourage oil accumulation within said oil channel for subsequent distribution of oil to said feed dog bearing during rotation of said drive shaft.

7. The combination of claim 1 wherein said oil guideway further includes a drive shaft annular recess encircling said drive shaft and confronting said oil entry port to allow oil accumulation in said recess for lubrication of said drive shaft and said drive shaft bearing and for subsequent delivery to said feed dog cam.

8. The combination of claim 7 wherein said oil guideway further includes a feed dog cam annular recess encircling said feed dog cam and confronting said main feed dog bearing.

9. The combination according to claim 1 wherein:

said feed dog block includes a cylindrical bearing aperture having a central axis;

said feed dog assembly further includes feed dog block guide means supported by said housing and engaging said feed dog block, said guide means including a guide post slidably received in said cylindrical bearing aperture for relative movement between said guide post and said feed dog block; and a feed dog block oil passage extending between said cylindrical bearing aperture and said feed dog bearing and passing through said feed dog bearing to receive oil from said oil guideway and direct it to said cylindrical bearing aperture to thereby lubricate said aperture and said guide post, the movement of said block along said elliptical path tending to shake and oscillate the oil within said feed dog block oil passage to encourage retention of the oil within said block and slow seepage thereof into said cylindrical bearing aperture.

10. The combination according to claim 9 wherein said guide post has an annular recess formed to encircle said guide post and to at least intermittently confront said feed dog block oil passage as said feed dog block slides on said guide post to thereby store oil in said recess and distribute such oil to said guide post during sliding movement of said block.

11. The combination according to claim 9 wherein said feed dog block oil passage extends substantially horizontally between said main feed dog bearing and said cylindrical bearing aperture when said drive shaft is substantially vertical and wherein said feed dog block oil passage is positioned to be in substantial vertical alignment with said rotating feed dog cam oil passage of said feed dog bearing 12. The combination according to claim 11 wherein said feed dog block oil passage has a central axis and said oil passage axis intersects said cylindrical bearing aperture above the level of the bearing aperture axis thereby delivering oil to the upper half of said bearing aperture to directly lubricate the upper half of said guide post and to permit subsequent downward seepage of oil to the lower half of said guide post.

13. The combination according to claim 11 and further including a porous oil storage medium carried on said guide post and positioned between said guide means and said feed dog block to receive excess oil seeping from cylindrical bearing aperture, absorb and store such oil and subsequently release such oil to said guide post when said medium is compressed between said guide means and said feed dog block.

14. In combination with a self-oiling, portable, bag-closing sewing machine energizable from a power source and including a housing; an oil source capable of storing oil; first and second main drive shaft bearings positioned along a common axis, and each said bearing having an inner and outer periphery; and driving means selectively connectable to the power source, carried by said housing, and including a motor and a main drive shaft having a central longitudinal axis and upper and lower ends with said shaft being rotatably mounted in said first and second main drive shaft bearings for rotation about said longitudinal central axis and said main drive shaft being drivingly connected with said motor to rotate said main drive shaft when said motor is energized; and a feed dog assembly including a feed dog block having a main feed dog bearing therein; an improved lubrication system comprising:

said main drive shaft further including a feed dog cam adjacent said lower end of said drive shaft, said cam having an outer periphery and being rotatably journaled in said main feed dog bearing to move said feed dog block along an eliptical path in response to rotation of said drive shaft;

said main drive shaft including an oil guideway in fluid flow communication with said oil source and extending to said feed dog cam, said guideway receiving oil from said oil source and directing such oil to said outer periphery of said feed dog cam to lubricate said cam and said main feed dog bearing.

15. In combination with a self-oiling, portable, bag-closing sewing machine energizable from a power source and including a housing; an oil source carried by said housing and capable of storing oil; first and second main drive shaft bearings positioned along a common axis, and each said bearing having an inner and outer periphery with at least one of said bearings having a first oil entry port passing between said outer periphery and said inner periphery; and driving means selectively connectable to the power source, carried by said housing, and including a motor and a main drive shaft having a central longitudinal axis and upper and lower ends with said shaft being rotatably mounted in said first and second main drive shaft bearings for rotation about said longitudinal central axis and said main drive shaft being drivingly connected with said motor to rotate said main drive shaft when said motor is energized; and a feed dog assembly including a feed dog block having a main feed dog bearing therein; an improved lubrication system comprising:

oil delivery means connected in fluid flow relationship with said oil source and to said first oil entry port of said drive shaft bearing;

said main drive shaft including an oil bore communicating with said first oil entry port and further including an oil channel along said central axis of said main drive shaft and extending upwardly from said lower end of said shaft and communicating with said oil bore, said oil bore receiving oil from said oil port and directing such oil to and downwardly along said oil channel;

said main drive shaft further including a feed dog cam adjacent said lower end, said cam having an outer periphery and being rotatably journaled in said feed dog bearing;

said feed dog cam including a feed dog cam oil passage extending from said outer periphery of said cam radially inwardly to said oil channel of said drive shaft along a radius of said drive shaft so that oil reaching said oil passage from said oil channel is urged radially outwardly along said oil passage by centrifugal force during rotation of said drive shaft and applied within said main feed dog bearing to lubricate said feed dog cam and feed dog bearing; and means closing the end of said oil channel at the said lower end of said drive shaft to permit oil to accumulate within said oil channel for subsequent radial movement to said feed dog bearing during rotation of said drive shaft.

* * * * *